US009183803B2

(12) United States Patent
Jeong et al.

(10) Patent No.: US 9,183,803 B2
(45) **Date of Patent: *Nov. 10, 2015**

(54) DISPLAY DEVICE AND DRIVING METHOD THEREOF

(75) Inventors: Jae-Won Jeong, Seoul (KR); Kwan-Young Oh, Seoul (KR); Po-Yun Park, Seoul (KR); Jung Hwan Cho, Asan-si (KR)

(73) Assignee: Samsung Display Co., Ltd. (KR)

( * ) Notice: Subject to any disclaimer, the term of this patent is extended or adjusted under 35 U.S.C. 154(b) by 356 days.

This patent is subject to a terminal disclaimer.

(21) Appl. No.: 13/569,111

(22) Filed: Aug. 7, 2012

(65) Prior Publication Data

US 2013/0106895 A1 May 2, 2013

(30) Foreign Application Priority Data

Oct. 26, 2011 (KR) ..... 10-2011-0109915

(51) Int. Cl.
*G09G 3/36* (2006.01)

(52) U.S. Cl.
CPC ..... *G09G 3/3648* (2013.01); *G09G 2320/0233* (2013.01); *G09G 2320/103* (2013.01); *G09G 2330/021* (2013.01); *G09G 2340/0435* (2013.01); *G09G 2360/18* (2013.01)

(58) Field of Classification Search
CPC ..... G09G 2330/021; G09G 3/3648; G09G 2340/0435; G09G 2360/18; G09G 2320/103; G09G 2320/0233; G09G 3/36–3/3696
See application file for complete search history.

(56) References Cited

U.S. PATENT DOCUMENTS

| | | | | |
|---|---|---|---|---|
| 7,362,295 | B2 * | 4/2008 | Park et al. | 345/89 |
| 7,612,505 | B2 | 11/2009 | Min et al. | |
| 2002/0067332 | A1 | 6/2002 | Hirakata et al. | |
| 2004/0179002 | A1 | 9/2004 | Park et al. | |
| 2005/0068289 | A1 | 3/2005 | Diefenbaugh et al. | |
| 2007/0103424 | A1 | 5/2007 | Huang | |
| 2007/0176883 | A1 | 8/2007 | Hsu et al. | |
| 2008/0117223 | A1 | 5/2008 | Mayer et al. | |
| 2009/0096769 | A1 | 4/2009 | Kim et al. | |
| 2009/0244112 | A1 * | 10/2009 | Jung et al. | 345/691 |
| 2013/0027379 | A1 | 1/2013 | Lee et al. | |

FOREIGN PATENT DOCUMENTS

| | | | |
|---|---|---|---|
| CN | 101188105 | A | 5/2008 |
| JP | 06-267660 | | 9/1994 |
| JP | 06-333695 | | 12/1994 |
| JP | 2006-073199 | | 3/2006 |
| JP | 2010-066725 | | 3/2010 |
| KR | 1020070076078 | A | 7/2007 |
| KR | 100767868 | | 10/2007 |
| KR | 1020080002427 | A | 1/2008 |
| KR | 10-2013-0012381 | | 7/2011 |

* cited by examiner

*Primary Examiner* — Yong H Sim
(74) *Attorney, Agent, or Firm* — Innovation Counsel LLP

(57) ABSTRACT

A display device capable of reducing power consumption and preventing luminance changes, and a driving method thereof are provided. The display device includes: a display panel displaying a still image and a motion picture; a signal controller controlling signals for driving the display panel; a graphic processing unit transmitting input image data to the signal controller; a light source unit irradiating the display panel with light; and a light source driver controlling signals for driving the light source unit, in which the signal controller includes a frame memory storing the input image data and controls the display panel so as to be driven at a first frequency or a second frequency, and the light source driver drives the light source unit at a first ratio when the display panel is driven at the first frequency and at a second ratio when the display panel is driven at the second frequency.

12 Claims, 18 Drawing Sheets

DISPLAY DEVICE AND DRIVING METHOD THEREOF

CROSS-REFERENCE TO RELATED APPLICATION

This application claims priority to and the benefit of Korean Patent Application No. 10-2011-0109915 filed in the Korean Intellectual Property Office on Oct. 26, 2011, the entire contents of which are incorporated herein by reference.

BACKGROUND OF THE INVENTION (a) Field of the Invention

The present invention relates to a display device and a driving method thereof, and more particularly, to a display device capable of reducing power consumption and preventing a luminance change and a driving method thereof.

(b) Description of the Related Art

Currently, display devices are required for devices such as computer monitors, televisions, mobile phones, and the like, all of which are widely used. The display devices include cathode ray tube display devices, liquid crystal displays, plasma display devices, and the like.

Display devices include a graphic processing unit (GPU), a display panel, and a signal controller. The graphic processing unit transmits the image data for each screen to be displayed on the display panel to the signal controller. The signal controller generates a control signal for driving the display panel and transmits the control signal together with the image data to the display panel, thereby driving the display device.

Images displayed on the display panel are largely classified into still images and moving or motion pictures. The display panel displays several frames per second and in this case, if the image data included in each frame are the same as each other, the still image is displayed. Further, if the image data included in each frame are different from each other, the motion picture is displayed.

Because the signal controller receives the same image data from the graphic processing unit for every frame, even when the display panel displays a still image instead of a motion picture, the power consumption is increased.

Recently, many attempts have been made to reduce the power consumption of display devices. In one proposed method, the image data of the still image is stored in a frame memory by adding the frame memory in the signal controller and the stored image data is provided to the display panel while displaying the still image. Such method is referred to as a Panel Self Refresh (PSR) mode, and because the image data does not need to be received from the graphic processing unit while displaying the still image, the graphic processing unit is inactivated, thereby reducing the power consumption.

However, when a display device is being driven in the PSR mode, there is a problem in that the power consumption increases according to the addition of the frame memory.

The above information disclosed in this Background section is only for enhancement of understanding of the background of the invention and therefore it may contain information that does not form the prior art that is already known in this country to a person of ordinary skill in the art.

SUMMARY OF THE INVENTION

A display device having advantages of reducing power consumption and preventing a luminance change, and a driving method thereof are provided.

A display device includes: a display panel configured to display a still image and a motion picture; a signal controller configured to control signals for driving the display panel; a graphic processing unit configured to transmit input image data to the signal controller; a light source unit configured to irradiate the display panel with light; and a light source driver configured to control signals for driving the light source unit, in which the signal controller includes a frame memory configured to store the input image data and control the display panel so as to be driven at a first frequency or a second frequency, and the light source driver configured to drive the light source unit at a first ratio when the display panel is driven at the first frequency and drive the light source unit at a second ratio when the display panel is driven at the second frequency.

The graphic processing unit may transmit a still image start signal and a still image end signal to the signal controller.

The signal controller may be configured to store the input image data in the frame memory and inactivate the transmission of the input image data when the still image start signal is applied, and activate the transmission of the input image data when the still image end signal is applied.

The signal controller may be configured to output the storage image data stored in the frame memory to the display panel at the first frequency when the still image start signal is applied and output the input image data to the display panel at the second frequency when the still image end signal is applied.

The first frequency may have a value lower than the second frequency, the first ratio may have a value lower than the second ratio when the display panel is in a normally black mode, and the first ratio may have a value higher than the second ratio when the display panel is in a normally white mode.

The signal controller may further include a signal receiving unit configured to transmit the input image data from the graphic processing unit; and a driving frequency selecting unit configured to select the first frequency when the still image is displayed and select the second frequency when the motion picture is displayed.

The light source driver may include a driving frequency receiving unit configured to receive a driving frequency of the display panel from the signal controller; a light source unit driving ratio selecting unit configured to determine a driving ratio of the light source unit according to the driving frequency; and a light source driving signal generator configured to generate a signal for driving the light source according to the driving ratio of the light source unit.

The signal controller may further include a frame counting unit configured to count the number of still image sequential frames inputted after the still image start signal is applied and before the still image end signal is applied and count the number of motion picture sequential frames inputted after the still image end signal is applied until the still image start signal is applied.

The signal controller may be configured to store the input image data in the frame memory and inactivate the transmission of the input image data when the number of sequential frames of the still image is equal to or more than a value m, and activate the transmission of the input image data when the number of sequential frames of the motion picture is equal to or more than a value n.

The signal controller may be configured to output the storage image data stored in the frame memory to the display panel at the first frequency when the number of sequential frames of the still image is equal to or more than m, and output the input image data to the display panel at the second frequency when the number of sequential frames of the motion picture is equal to or more than n.

In another aspect, a driving method of a display device is provided, including: transmitting input image data to a signal controller by a graphic processing unit; applying a still image start signal; driving a display panel at a first frequency and driving a light source unit at a first ratio; applying a still image end signal; and driving the display panel at a second frequency and driving the light source unit at a second ratio.

Applying a still image start signal may include storing the input image data in a frame memory, and the method may further include inactivating transmission of the input image data when the still image start signal is applied, and activating transmission of the input image data is activated when the still image end signal is applied.

The driving method may further include outputting the image data stored in the frame memory to the display panel at the first frequency when the still image start signal is applied, and outputting the input image data to the display panel at the second frequency when the still image end signal is applied. The first frequency may have a value lower than the second frequency, the first ratio may have a value lower than the second ratio when the display panel is in a normally black mode, and the first ratio may have a value higher than the second ratio when the display panel is in a normally white mode.

The display panel may display a still image and a motion picture, and the display panel may be driven at the first frequency when the still image is displayed and driven at the second frequency when the motion picture is displayed.

The driving method may further include counting the number of sequential frames of the still image inputted after the still image start signal is applied and before the still image end signal is applied, and counting the number of sequential frames of the motion picture inputted after the still image end signal is applied until the still image start signal is applied.

When the number of the sequential frames of the still image is equal to or more than a value m, the input image data is stored in the frame memory and the transmission of the input image data is inactivated, and when the number of the sequential frames of the motion picture is equal to or more than a value n, the transmission of the input image data is activated.

When the number of the still image sequential frames is equal to or more than the value m the storage image data stored in the frame memory is outputted to the display panel at the first frequency, and when the number of sequential frames of the motion picture is equal to or more than the value n the input image data is outputted to the display panel at the second frequency.

The first ratio and the second ratio may be selected by using at least one of a lookup table or a function.

A conversion from driving the display panel at the first frequency to driving the display panel at the second frequency may be performed in a vertical blank time; and a conversion from driving the lights source at the first ratio to driving the light source at the second ratio may be performed in the vertical blank time.

Thus, a display panel is driven at the lower frequency when the still image is displayed as compared with the motion picture, such that it is possible to reduce power consumption. In this case, it is possible to prevent a luminance change according the change in the frequency by dimming-driving a light source unit according to the change in the frequency.

Further, it is possible to further prevent a luminance change according the change in the frequency by changing the driving frequency of the display panel when the number of sequential frames of the still image and the number of sequential frames of the motion picture are equal to or more than the predetermined number.

DETAILED DESCRIPTION OF THE EMBODIMENTS

Figure 1:
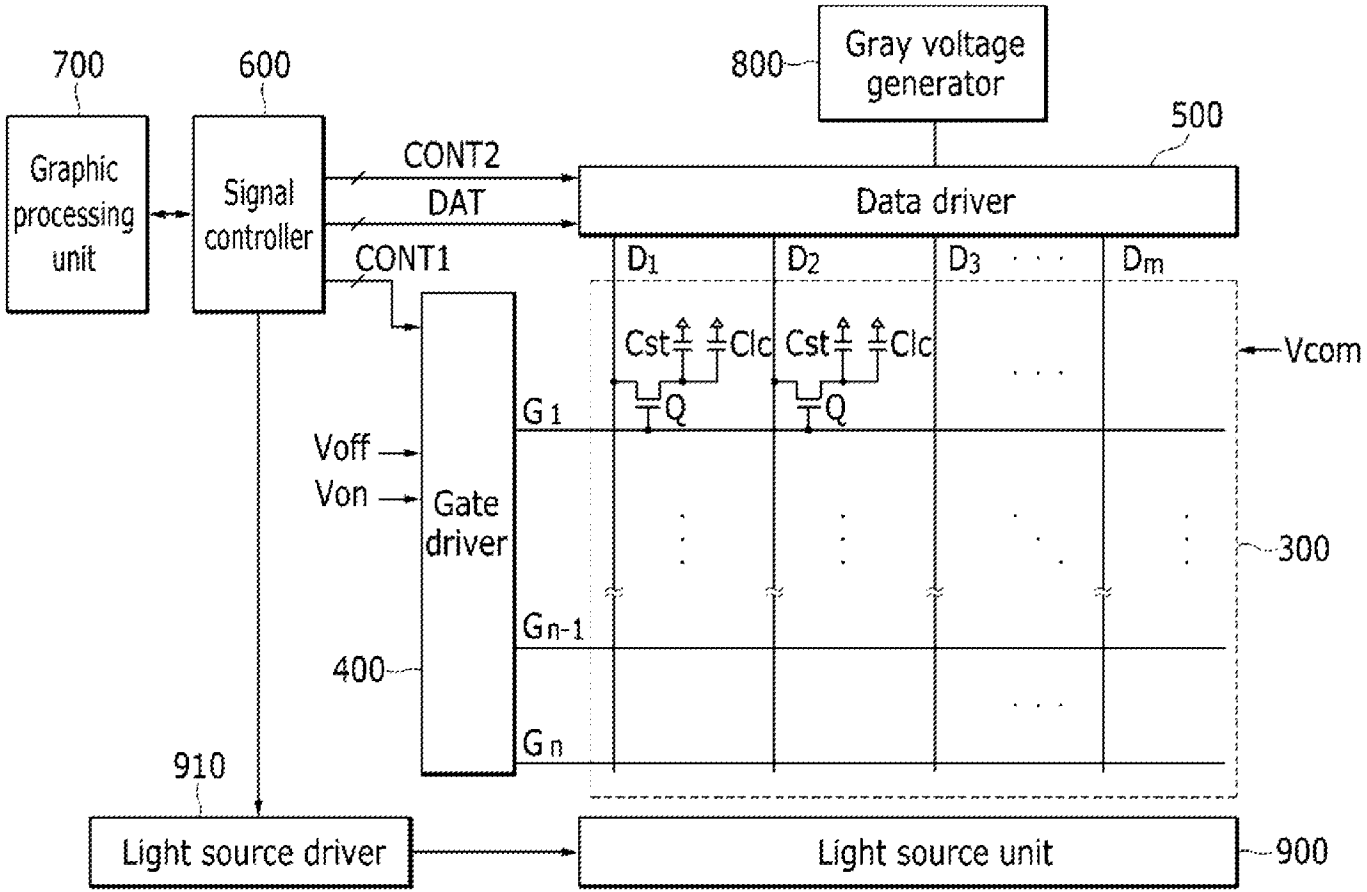
FIG. 1 is a block diagram of a display device according to a first exemplary embodiment.

The exemplary embodiments will be described more fully hereinafter with reference to the accompanying drawings. As those skilled in the art would realize, the described embodiments may be modified in various different ways, all without departing from the spirit or scope of the present invention.

In the drawings, the thickness of layers, films, panels, regions, etc., are exaggerated for clarity. Like reference numerals designate like elements throughout the specification. It will be understood that when an element such as a layer, film, region, or substrate is referred to as being "on" another element, it can be directly on the other element, or intervening elements may also be present. In contrast, when an element is referred to as being "directly on" another element, there are no intervening elements present.

First, a display device according to a first exemplary embodiment will be described below with reference to the accompanying drawings.

FIG. 1 is a block diagram of a display device according to a first exemplary embodiment.

As shown in FIG. 1, the display device according to a first exemplary embodiment includes a display panel 300 for displaying an image, a signal controller 600 controlling signals for driving the display panel 300, and a graphic processing unit 700 transmitting input image data to the signal controller 600.

The display panel 300 receives image data DAT from the signal controller 600 to display a still image and a motion picture. If a sequence of frames each have the same image data DAT, the still image is displayed, and if a sequence of frames each have different image data DAT, the motion picture is displayed.

The display panel 300 includes a plurality of gate lines G1-Gn and a plurality of data lines D1-Dm, the plurality of gate lines G1-Gn extend in a horizontal direction, and the plurality of data lines D1-Dm extend in a vertical direction while crossing the plurality of gate lines G1-Gn.

One gate line G1-Gn and one data line D1-Dm are connected with one pixel and a switching element Q connected with the gate lines G1-Gn and the data lines D1-Dm is included in one pixel. A control terminal of the switching element Q is connected to the gate lines G1-Gn, an input terminal thereof is connected with the data lines D1-Dm, and an output terminal is connected with a liquid crystal capacitor $C_{LC}$ and a storage capacitor $C_{ST}$ of the pixel.

The display panel 300 of FIG. 1 is shown as the liquid crystal panel, but the present invention is not limited thereto and may use various display panels.

In response to the input image data received from the graphic processing unit 700 and the control signals thereof, the signal controller 600 processes the input image data and the control signals, so as to be suitable for operating the liquid crystal panel 300. The control signals may include, for example, a vertical synchronization signal Vsync, a horizontal synchronization signal Hsync, a main clock signal MCLK, a data enable signal DE, and the like. After receiving the input image data and the control signals, the signal controller 600 generates and outputs a gate control signal CONT1 and a data control signal CONT2.

The gate control signal CONT1 includes a vertical synchronization start signal STV (hereinafter, referred to as a 'STV signal') instructing an output start of a gate-on pulse (high period of a gate signal GS) and a gate clock signal CPV (hereinafter, referred to as a 'CPV signal') controlling an output time of the gate-on pulse.

The data control signal CONT2 includes a horizontal synchronization start signal STH instructing an input start of the image data DAT and a load signal TP applying the corresponding data voltage to the data lines D1-Dm.

The graphic processing unit 700 transmits the input image data to the signal controller 600. When the input image data is for a motion picture to be displayed on the display panel 300, the graphic processing unit 700 transmits the input image data to the signal controller 600 for every frame. When the input image data is for a still image to be displayed on the display panel 300, because the signal controller 600 stores the input image data received from the graphic processing unit 700 to transmit the input image data to the display panel 300, the graphic processing unit 700 dose not transmit the input image data to the signal controller 600. That is, when the input image data to be displayed on the display panel 300 is for still image, the graphic processing unit 700 is inactivated.

When converting from displaying motion picture to displaying still image data, the graphic processing unit 700 transmits a still image start signal to the signal controller 600. Further, when converting from displaying still image data to displaying motion picture, the graphic processing unit 700 transmits a still image end signal to the signal controller 600.

The display device according to a first exemplary embodiment may further include a light source unit 900 irradiating light to the display panel 300 and a light source driver 910 controlling signals for driving the light source unit 900.

The light source unit 900 supplies the light to the inside of the display panel 300 and the supplied light is emitted to the outside of the liquid crystal display panel 300 to display a screen. The light source unit 900 may be configured by various light sources and for example, a light emitting diode (LED), a cold cathode fluorescent lamp (CCFL), an external electrode fluorescent lamp (EEFL), and the like may be used. Further, the light source unit 900 is classified as a side light type or a direct light type depending on the layout form of the light sources.

The light source driver 910 controls a dimming driving of the light source unit 900. The dimming driving is a technique of controlling the amount of light provided by the light source in consideration of luminance of images, in order to prevent a contrast ratio (CR) of an image from being reduced and minimize power consumption.

The display device according to a first exemplary embodiment may further include a gate driver 400 driving the gate lines G1-Gn and a data driver 500 driving the data lines D1-Dm.

The plurality of gate lines G1-Gn of the display panel 300 are connected to the gate driver 400, and the gate driver 400 alternately applies gate-on voltage Von and gate-off voltage Voff to the gate lines G1-Gn according to the gate control signal CONT1 applied from the signal controller 600.

The plurality of data lines D1-Dm of the display panel 300 are connected to the data driver 500, and the data driver 500 receives the data control signal CONT2 and the image data DAT from the signal controller 600. The data driver 500 converts the image data DAT into data voltage by using gray voltage generated from a gray voltage generator 800 and transfers the converted data voltage to the data lines D1-Dm.

Next, a signal controller of the display device according to a first exemplary embodiment will be described.

Figure 2:
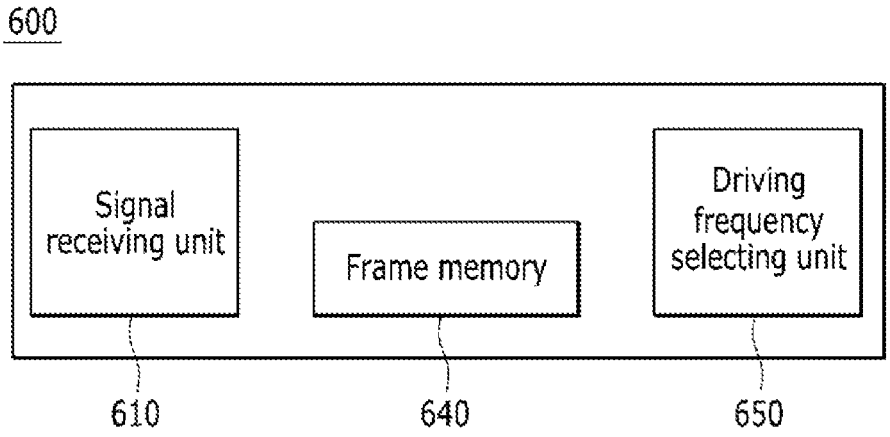
FIG. 2 is a block diagram illustrating a signal controller of the display device according to the first exemplary embodiment.

FIG. 2 is a block diagram illustrating a signal controller of the display device according to a first exemplary embodiment.

The signal controller 600 may include a signal receiving unit 610 receiving various signals from the graphic processing unit 700, a frame memory 640 storing the input image data, and a driving frequency selecting unit 650 selecting a first frequency when displaying a still image and selecting a second frequency when displaying a motion picture.

The signal receiving unit 610 receives the input image data, the still image start signal, and the still image end signal from the graphic processing unit 700. Although not shown, the signal receiving unit 610 is connected with the graphic processing unit 700 through a main link and a sub link. The signal receiving unit 610 receives the input image data from the graphic processing unit 700 through the main link. Further, the signal receiving unit 610 receives the still image start signal and the still image end signal from the graphic processing unit 700 through the sub link, and transmits a signal for notifying a driving state of the display panel 300 to the graphic processing unit 700.

The frame memory 640 receives and stores the input image data from the signal receiving unit 610. When the image data to be displayed on the display panel is for a motion picture, the frame memory 640 is not used. When the image data to be displayed on the display panel is for a still image, the input image data is stored in the frame memory 640, and the storage image data stored in the frame memory 640 is outputted to the display panel 300.

The driving frequency selecting unit 650 selects the first frequency when a still image is to be displayed on the display panel, and selects the second frequency when a motion picture is to be displayed on the display panel. When the still image is to be displayed, the storage image data is received from the frame memory 640 to be outputted to the display panel 300 at the first frequency. When the motion picture is to be displayed, the input image data is received from the signal receiving unit 610 to be outputted to the display panel 300 at the second frequency.

In this case, the first frequency has a value lower than the second frequency.

For example, when the motion picture is displayed, the display panel may display the screen by reproducing 60 frames per 1 sec, and when the still image is displayed, the display panel may display the screen by reproducing 30 frames per 1 sec. In this case, when the still image is displayed, the power consumption is reduced as compared with the case where the motion picture is displayed. Accordingly, the driving frequency when the still image is displayed is set to a predetermined ratio or less as compared with the driving frequency when the motion picture is displayed, thereby reducing the power consumption by, or by more than, the amount the power consumption is increased due to the addition of the frame memory.

When the motion picture is displayed, if the driving frequency is reduced, there is a problem in that the motion looks unnatural, but when the still image is displayed, because the frame having the same image data DAT is repetitively reproduced, although the driving frequency is reduced, such a problem does not occur.

Next, a light source driver of the display device according to a first exemplary embodiment will be described.

Figure 3:
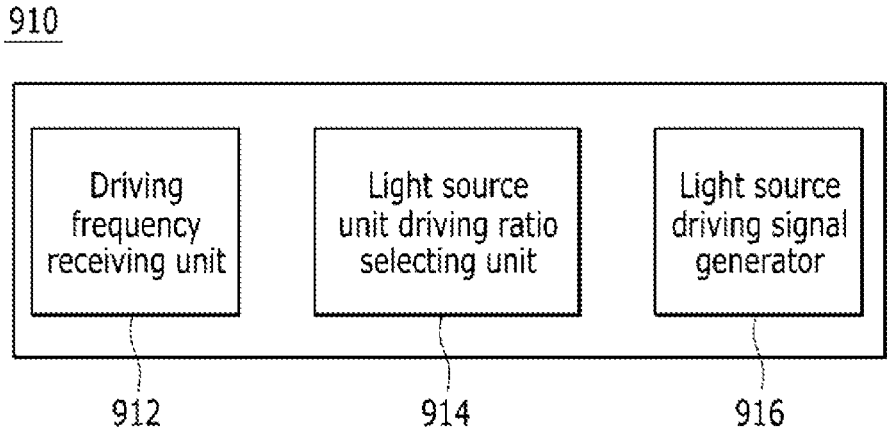
FIG. 3 is a block diagram illustrating a light source driver of the display device according to the first exemplary embodiment.

FIG. 3 is a block diagram illustrating a light source driver of the display device according to a first exemplary embodiment.

The light source driver 910 includes a driving frequency receiving unit 912 receiving the driving frequency of the display panel 300 from the signal controller 600, a light source unit driving ratio selecting unit 914 determining a driving ratio of the light source unit 900 according to the driving frequency, and a light source driving signal generator 916 generating a signal driving the light source 900 according to the driving ratio of the light source unit 900.

The driving frequency receiving unit 912 receives the first frequency from the signal controller 600 when the still image is displayed, and receives the second frequency from the signal controller 600 when the motion picture is displayed.

The driving ratio selecting unit 914 receives the driving frequency from the driving frequency receiving unit 912 to select the ratio driving the light source unit. The driving ratio of the light source unit may be selected, and is different, depending on the driving frequency.

For example, the driving ratio of the light source unit 900 according to the driving frequency of the display panel 300 may be selected by using a lookup table. The driving ratio selecting unit 914 selects the driving ratio of the light source unit as a first ratio when the driving frequency is the first frequency, and selects the driving ratio of the light source unit as a second ratio, which is different from the first ration, when the driving frequency is the second frequency, by using the lookup table, for instance, as shown in Table 1. That is, when the still image is displayed, the light source unit is driven at the first ratio, and when the motion picture is displayed, the light source unit is driven at the second ratio.

TABLE 1

| Driving frequency(Hz) | Driving ratio of light source unit (%) |
|---|---|
| First frequency | First ratio |
| Second frequency | Second ratio |

When the frequency of driving the display panel 300 is changed and reduced, a charging time of each pixel increases and a charged charge amount increases. Accordingly, the luminance of the display may be changed before and after a time when the frequency changes. In a normally black mode display device, as the charged charge amount increases, the luminance increases, whereas in a normally white mode display device, as the charged charge amount increases, the luminance decreases.

Accordingly, when the first frequency has a value that is lower than the second frequency, in a normally black mode display device, the first ratio is set to a value lower than the second ratio, in order to compensate the increased luminance. In this case, the power consumption may be reduced by decreasing the driving ratio of the light source unit.

On the contrary, in a normally white mode display device, the first ratio is set to a value that is higher than the second ratio, in order to compensate the decreased luminance.

As described above, the driving ratio of the light source unit 900 according to the driving frequency of the display panel 300 may be selected by using the lookup table, but the present invention is not limited thereto and the driving ratio may be selected by using, for example, a function of $y=f(x)$.

The light source driving signal generator 916 receives the driving ratio of the light source unit selected by the driving ratio selecting unit 914 to generate a signal capable of driving the light source unit at the first ratio or a signal capable of driving the light source unit at the second ratio, and transmits the signals to the driver 900. In this case, the signals generated by the light source driving signal generator 916 may be various signals such as a PWM signal, a communication protocol such as $I^2C$ or the like, and the like.

Hereinafter, a driving method of the display device according to a first exemplary embodiment will be described below.

Figure 4:
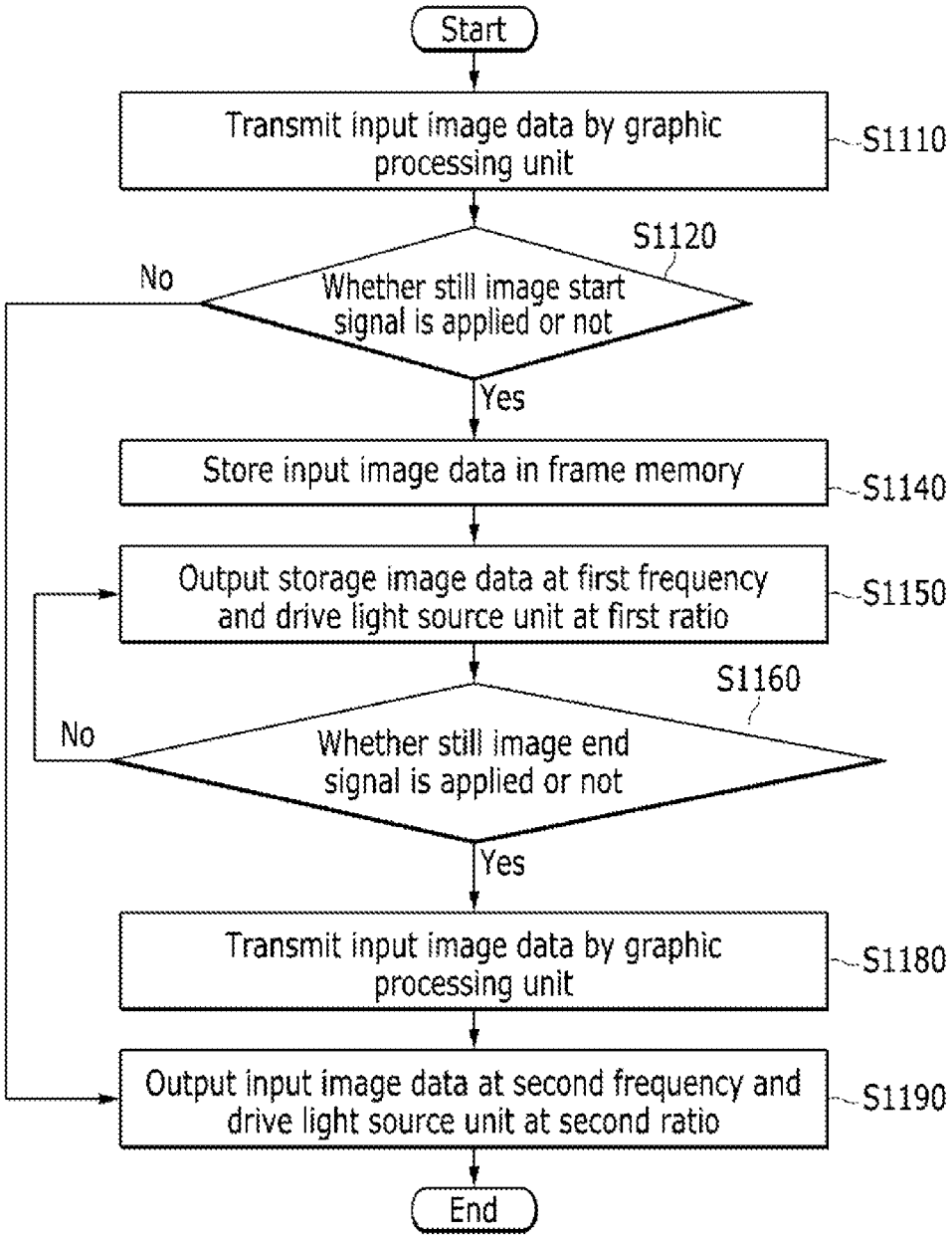
FIG. 4 is a flowchart illustrating a driving method of the display device according to the first exemplary embodiment.
Figure 5:
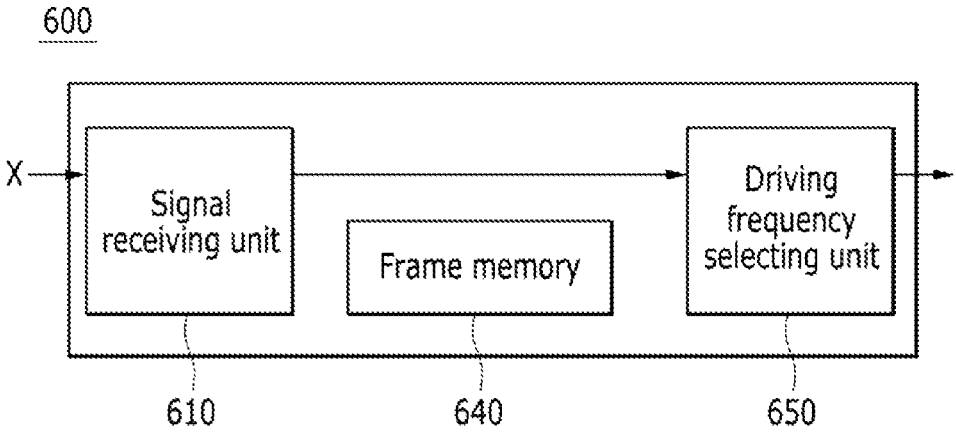
FIGS. 5 to 7 are block diagrams of the signal controller illustrating the driving method of the display device according to the first exemplary embodiment for steps in a sequence.
Figure 6:
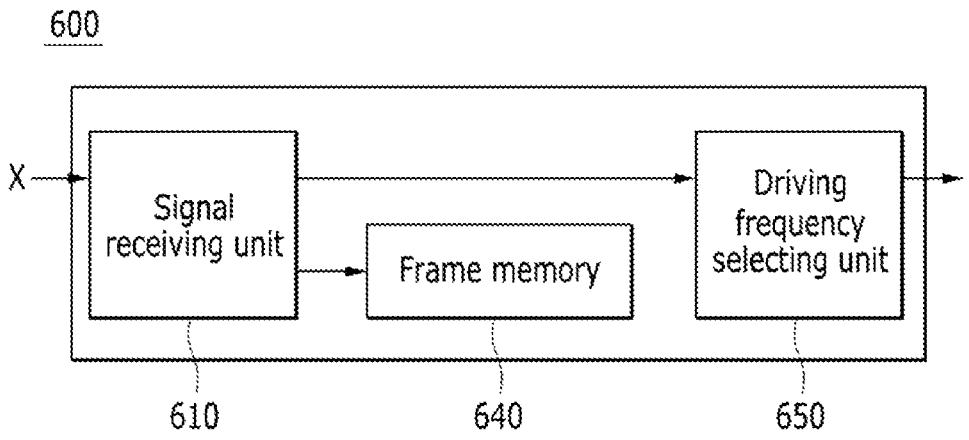
Figure 7:
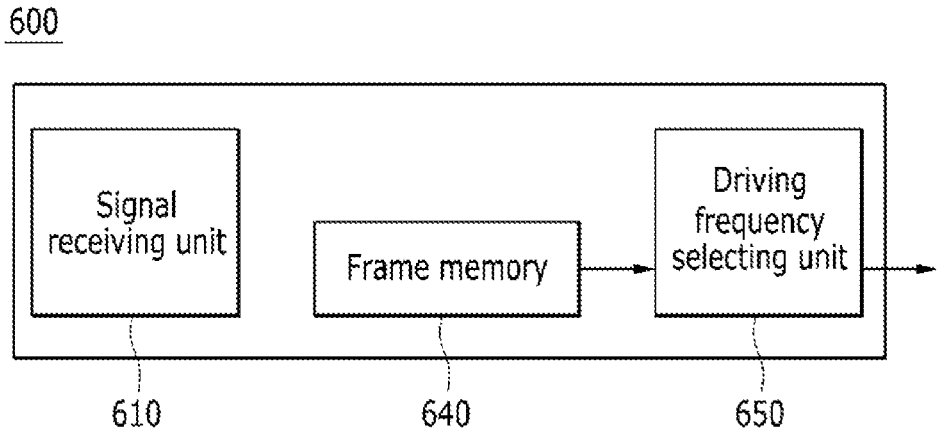
Figure 8:
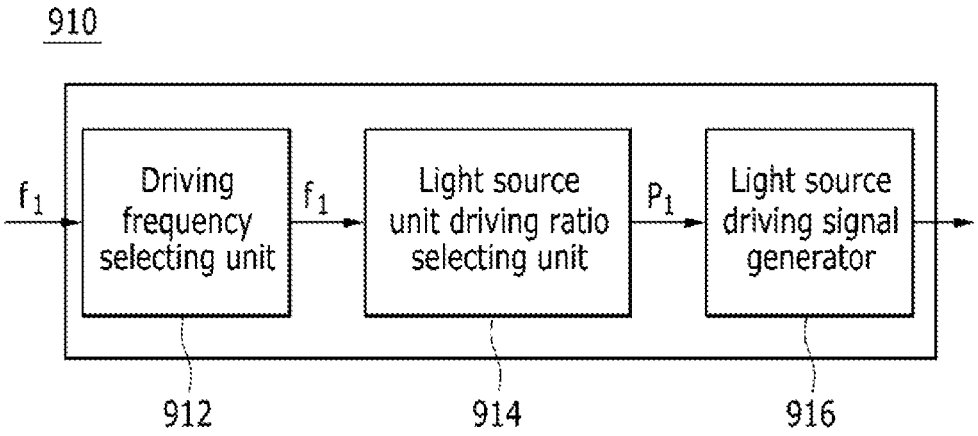
FIGS. 8 to 9 are block diagrams of the light source driver illustrating the driving method of the display device according to the first exemplary embodiment for steps in a sequence.
Figure 9:
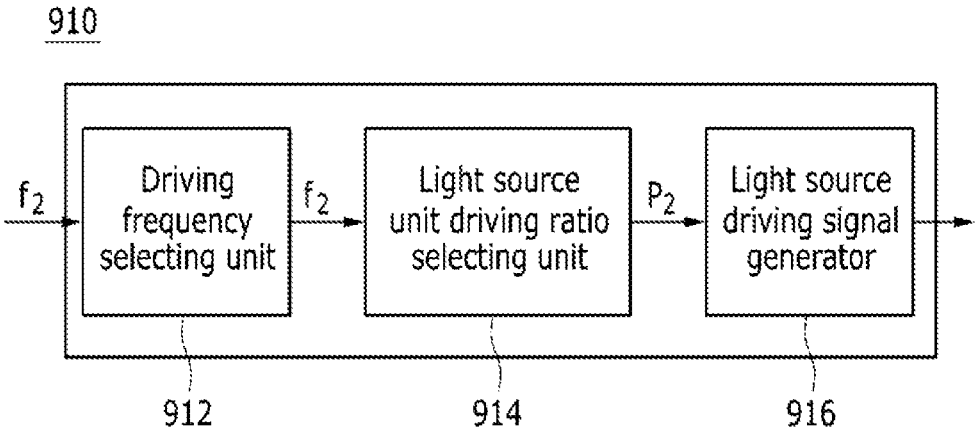

FIG. 4 is a flowchart illustrating a driving method of the display device according to a first exemplary embodiment, FIGS. 5 to 7 are block diagrams of the signal controller illustrating the driving method of the display device according to a first exemplary embodiment for steps in a sequence, and FIGS. 8 to 9 are block diagrams of the light source driver illustrating the driving method of the display device according to a first exemplary embodiment for steps in a sequence.

First, as shown in FIG. 5, the graphic processing unit transmits the input image data X] to the signal receiving unit 610 of the signal controller 600 (S1110) (FIG. 4).

It is determined whether or not the still image start signal is applied to the signal receiving unit (S1120), and if the still image start signal is not applied, the input image data is outputted to the display panel (S1190).

If the still image start signal is applied, as shown in FIG. 6, the input image data is stored in the frame memory 640 (S1140).

Subsequently, as shown in FIG. 7, the graphic processing unit is inactivated so that the graphic processing unit does not transmit the input image data and the storage image data stored in the frame memory 640 is outputted (S1150). If the still image start signal is applied, the driving frequency selecting unit 650 selects the first frequency to output the storage image data to the display panel at the first frequency. In this case, the display panel displays the still image and is driven at the first frequency.

Simultaneously, as shown in FIG. 8, in the light source driver 910, the driving frequency receiving unit 912 receives a first frequency $f_1$ as the driving frequency and the light source unit driving ratio selecting unit 914 selects a first ratio $P_1$ as the driving ratio of the light source unit.

The driving ratio of the light source unit may be selected, and be different, based on the driving frequency. In this case, the driving ratio of the light source unit 900 according to the driving frequency of the display panel may be selected by using, for example, the lookup table or the function of y=f(x).

The light source driving signal generator 916 generates a light source driving signal capable of driving the light source unit at the first ratio $P_1$, to output the generated light source driving signal to the light source unit. In this case, the light source driving signal may be various signals such as a PWM signal, a communication protocol such as $I^2C$ or the like, and the like.

Subsequently, it is determined whether or not the still image end signal is applied (S1160) and if the still image end signal is not applied, the storage image data is outputted at the first frequency and the light source unit is driven at the first ratio (S1150).

If the still image end signal is applied, then, as shown in FIG. 5, the graphic processing unit is again activated so as to transmit the input image data (S1180).

If the still image end signal is applied, the driving frequency selecting unit 650 selects the second frequency to output the input image data to the display panel at the second frequency (S1190). In this case, the display panel displays the motion picture and is driven at the second frequency.

Simultaneously, as shown in FIG. 9, in the light source driver 910, the driving frequency receiving unit 912 receives a second frequency $f_2$ as the driving frequency and the light source unit driving ratio selecting unit 914 selects the second ratio $P_2$ as the driving ratio of the light source unit.

The light source driving signal generator 916 generates a light source driving signal capable of driving the light source unit at the second ratio $P_2$ to output the generated light source driving signal to the light source unit.

In the driving method of the display device according to a first exemplary embodiment, when a still image is displayed, the display panel is driven at the first frequency and the light source unit is driven at the first ratio. Further, when a motion picture is displayed, the display panel is driven at the second frequency and the light source unit is driven at the second ratio.

In this case, the first frequency has a value lower than the second frequency. Because for a still image the same image is displayed for every frame, the still image can be implemented even at a low driving frequency. However, a charging time of the pixel is changed based on the change in the driving frequency and the charged charge amount is changed. As a result, a change in the luminance of the display may be recognized with a user's eyes.

Accordingly, the light source unit is dimming-driven, such that the change in the luminance may not be recognized by a user's eyes. In detail, when the display panel is driven at the first frequency, the light source unit is driven at the first ratio and when the display panel is driven at the second frequency, the light source unit is driven at the second ratio.

In a normally black mode display device, the first ratio is set to a value lower than the second ratio. In this case, the first ratio and the second ratio are set at a value capable of compensating for the increase in luminance when the still image is displayed as compared with the motion picture.

In a normally white mode display device, the first ratio is set to a value higher than the second ratio. In this case, the first ratio and the second ratio are set to a value capable of compensating for the decrease in luminance when the still image is displayed as compared with the motion picture.

When the still image is converted into the motion picture, a time at which the driving frequency of the display panel is changed and a time at which the driving ratio of the light source unit is changed coincide with a vertical blank time (V-blank time), such that the luminance change may not be further recognized or noticed by a user.

Next, a display device according a second exemplary embodiment will be described below with reference to the accompanying drawings.

The largest difference from a first exemplary embodiment described above is in that the signal controller further includes a frame counting unit and such a second exemplary embodiment will be described below in more detail.

Figure 10:
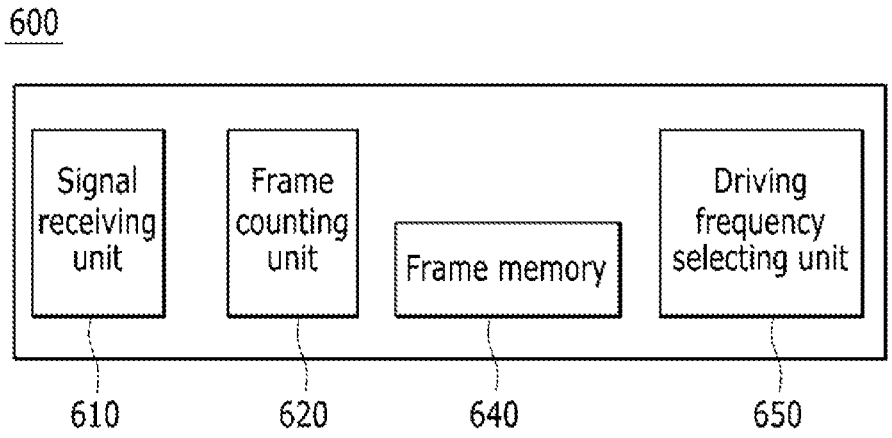
FIG. 10 is a block diagram illustrating a signal controller according to a second exemplary embodiment.

FIG. 10 is a block diagram illustrating a signal controller according to a second exemplary embodiment. Because the display device according to a second exemplary embodiment is essentially the same as the first exemplary embodiment except for the signal controller, the display device according to a second exemplary embodiment will be described with reference to FIG. 10 together with FIGS. 1 and 3, and also, the description thereof is omitted and only differences will be described below.

A display device according to a second exemplary embodiment is the same as the display device according to a first exemplary embodiment described above in that the display device according to a second exemplary embodiment includes a display panel 300 displaying an image, a signal controller 600 controlling signals for driving the display panel 300, a graphic processing unit 700 transmitting input image data to the signal controller 600, a light source unit 900 irradiating light to the display panel 300, and a light source driver 910 controlling signals for driving the light source unit 900, as shown in FIG. 1.

The signal controller 600 may include a signal receiving unit 610 receiving various signals from the graphic processing unit 700, a frame counting unit 620 counting the number of frames, a frame memory 640 storing the input image data, and a driving frequency selecting unit 650 selecting a first frequency when displaying the still image and selecting a second frequency when displaying the motion picture.

The signal receiving unit 610 receives the input image data, a still image start signal, and a still image end signal from the graphic processing unit 700. Although not shown, the signal receiving unit 610 is connected with the graphic processing unit 700 through a main link and a sub link. The signal receiving unit 610 receives the input image data from the graphic processing unit 700 through the main link. Further, the signal receiving unit 610 receives the still image start signal and the still image end signal from the graphic processing unit 700 through the sub link, and transmits a signal for notifying the graphic processing unit 700 of the driving state of the display panel 300.

The frame counting unit 620 counts the number of sequential frames of a still image that are inputted between the application of the still image start signal and the still image end signal, and similarly counts the number of sequential frames of a motion picture that are inputted starting after the still image end signal is applied and counting until the still image start signal is applied.

The frame counting unit 620 transmits the input image data to the frame memory 640 when the number of sequential frames of a still image is equal to or more than a set value m. Further, when the number of sequential frames of a still image is equal to or more than the set value m, the graphic processing unit 700 is inactivated so that the graphic processing unit 700 does not transmit the input image data. On the other hand, when the number of the sequential frames of a still image is less than the set value m, the input image data is not transmitted to the frame memory 640, but transmitted to the driving frequency selecting unit 650, so that the input image data is outputted. Further, when the number of the sequential frames of a still image is less than the set value m, the graphic processing unit 700 is not inactivated, so that the input image data is continuously transmitted.

This process is done so as to not convert the mode of operation of the signal processor 600 and frequency used by the light source unit 900 from motion picture mode into the still image mode when the number of the still image sequential frames is less than m. When the still image is to be displayed for only a short time, and then converted into the motion picture again, the reduction in power consumption when the driving frequency is accordingly changed is not large, such that the luminance change does not occur by maintaining the driving frequency. Although the light source unit is dimming-driven according to the change in the driving frequency, the luminance change may be partially recognized by a viewer. Accordingly, when the still image is to be displayed for only a short time (i.e., less than m number of frames), the driving frequency of the display panel 300 and the driving ratio of the light source unit 900 are not changed, but maintained, such that any resulting luminance change may not occur.

When the number of the motion picture sequential frames is equal to or more than a set value n, the frame counting unit 620 activates the graphic processing unit 700 so that the graphic processing unit 700 transmits the input image data. On the contrary, when the number of the motion picture sequential frames is less than n, the graphic processing unit 700 is maintained in the inactivated state.

This process is done so as to not convert the frequency used by the signal processor 600 and light source unit 900 from still image mode into the motion picture mode when the number of the motion picture sequential frames is less than n. When the motion picture is to be displayed for only a short time, and then converted into the still image again, the reduction is power consumption if the driving frequency is accordingly changed is not large, such that the luminance change does not occur by maintaining the driving frequency. That is, when the motion picture is to be displayed for only a short time, the driving frequency of the display panel 300 and the driving ratio of the light source unit 900 are not changed, but maintained, such that any resulting luminance change may not occur.

In this case, the values of m and n may be appropriately selected and set in consideration of the effect of the reduction in the power consumption and the potential visibility problem that may result from a luminance change.

The frame memory 640 receives and stores the input image data from the frame counting unit 620 when the number of sequential frames of a still image is equal to or more than m.

The driving frequency selecting unit 650 selects the first frequency when the display panel 300 is to continuously display a still image by m frames or more and selects the second frequency when the display panel 300 is to continuously display a motion picture by n frames or more. The driving frequency selecting unit 650 outputs the storage image data stored in the frame memory 640 to the display panel 300 at the first frequency when the number of sequential frames of a still image is equal to or more than m. The driving frequency selecting unit 650 outputs the input image data to the display panel 300 at the second frequency when the number of sequential frames of a motion picture is equal to or more than n.

Accordingly, the light source driver 910 receives the first frequency from the signal controller 600 to drive the light source unit 900 at the first ratio when the number of sequential frames of a still image is equal to or more than m. The light source driver 910 receives the second frequency from the signal controller 600 to drive the light source unit 900 at the second ratio when the number of sequential frames of a motion picture is equal to or more than n.

Hereinafter, a driving method of a display device according to a second exemplary embodiment will be described below.

Figure 11:
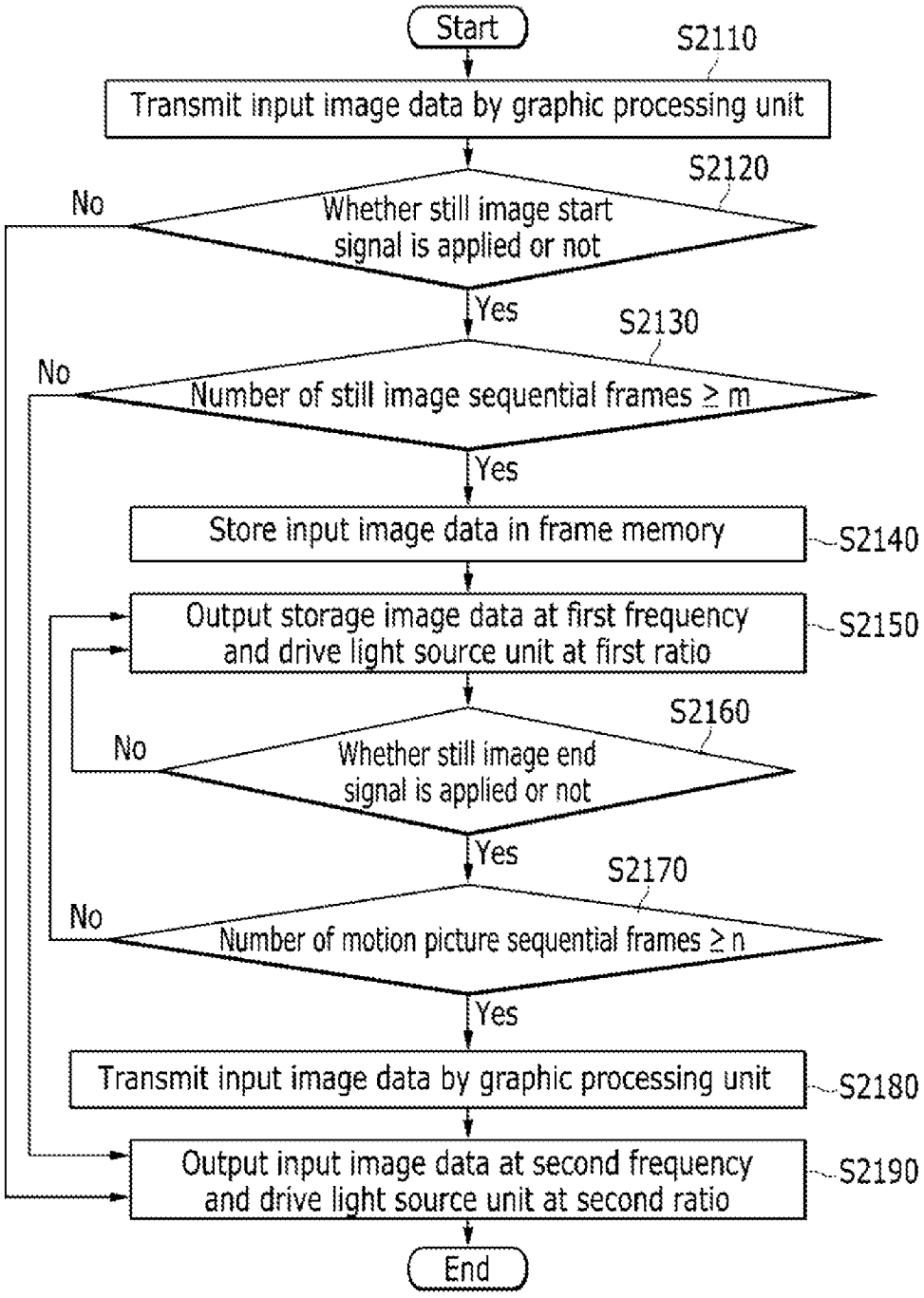
FIG. 11 is a flowchart illustrating a driving method of the display device according to the second exemplary embodiment.

FIG. 11 is a flowchart illustrating a driving method of the display device according to a second exemplary embodiment and FIGS. 12 to 15 are block diagrams of the signal controller illustrating the driving method of the display device according to a second exemplary embodiment for steps in a sequence.

Because the driving method of the display device according to a second exemplary embodiment is almost the same as the driving method of the display device according to a first exemplary embodiment as described above, the description thereof is omitted and differences will be mainly described below.

Figure 12:
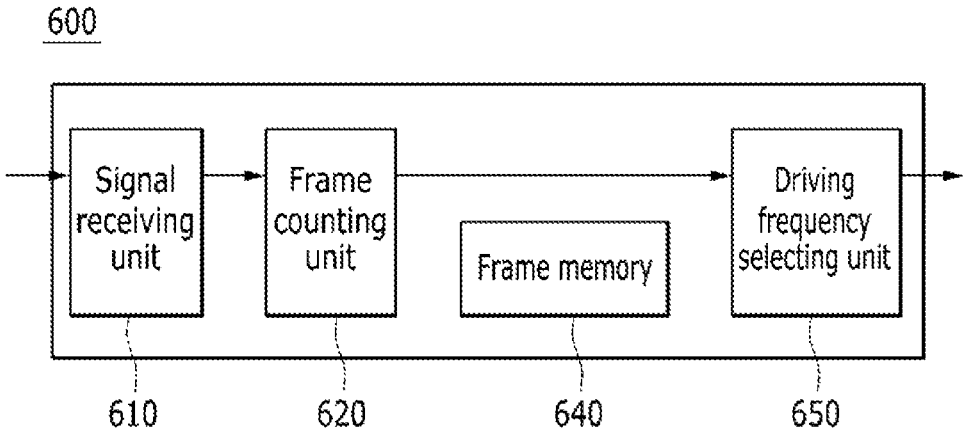
FIGS. 12 to 15 are block diagrams of the signal controller illustrating the driving method of the display device according to the second exemplary embodiment for steps in a sequence.

First, as shown in FIG. 12, the graphic processing unit transmits the input image data to the signal receiving unit 610 of the signal controller 600 (S2110).

It is determined whether or not the still image start signal is applied to the signal receiving unit 610 (S2120), and if the still image start signal is not applied, the input image data is outputted to the display panel (S2190). In this case, the display panel displays the motion picture and is driven at the second frequency.

If the still image start signal is applied, the frame counting unit 620 counts the number of sequential frames of the still image that are inputted between the application of the still image start signal and the still image end signal (S2130). In this case, the frame counting unit 620 determines whether or not the number of sequential frames of the still image is equal to or more than set value m. When the number of sequential frames of the still image is less than m, the input image data is outputted to the display panel like the case where the still image start signal is not applied (S2190). In this case, the display panel displays the still image and is driven at the second frequency.

Figure 13:
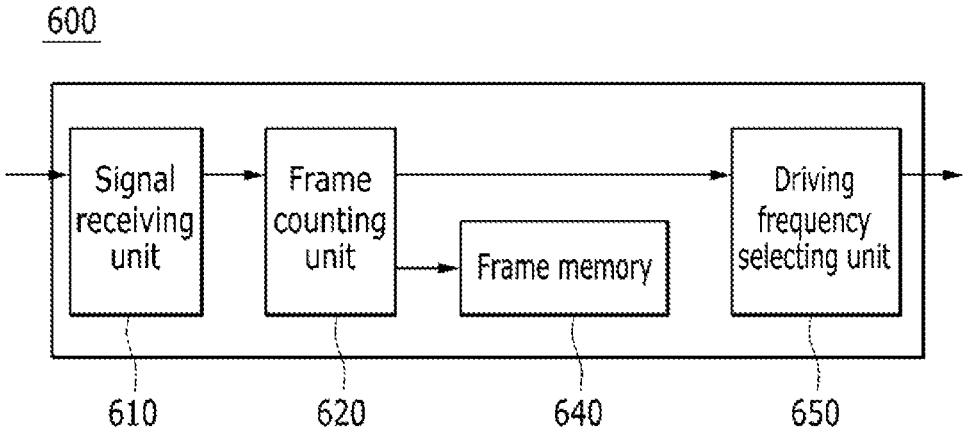

If the number of the still image sequential frames is equal to or more than m, as shown in FIG. 13, the input image data is stored in the frame memory 640 (S2140).

Figure 14:
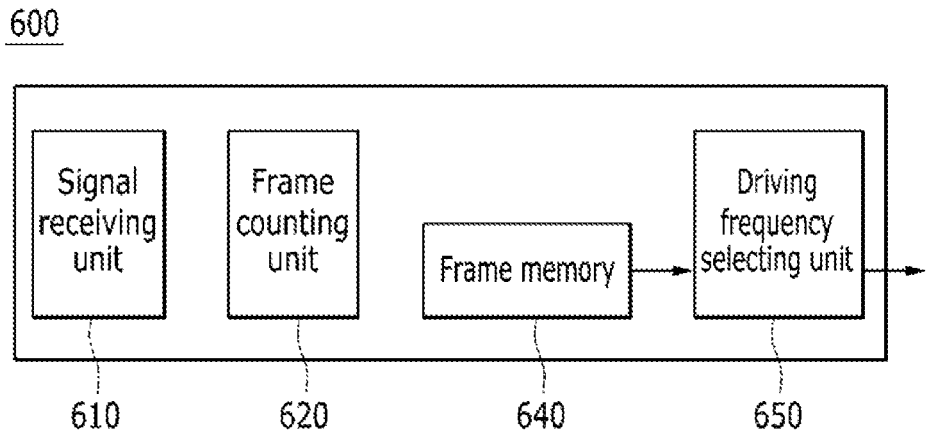

Subsequently, as shown in FIG. 14, the graphic processing unit is inactivated so that the graphic processing unit does not transmit the input image data and the storage image data stored in the frame memory 640 is outputted (S2150). If the number of sequential frames of the still image is equal to or more than m, the driving frequency selecting unit 650 selects the first frequency to output the storage image data to the display panel at the first frequency. In this case, the display panel displays the still image and is driven at the first frequency.

Simultaneously, the light source driver 910 receives the first frequency as the driving frequency to drive the light source unit at the first ratio.

The driving ratio of the light source unit may be selected, and is different, depending to the driving frequency. In this case, the driving ratio of the light source unit according to the driving frequency of the display panel may be selected, for example, by using the lookup table or the function of $y=f(x)$.

Subsequently, it is determined whether or not the still image end signal is applied (S2160), and if the still image end signal is not applied, the storage image data is outputted at the first frequency and the light source unit is driven at the first ratio (S2150). In this case, the display panel displays the still image and is driven at the first frequency.

Figure 15:
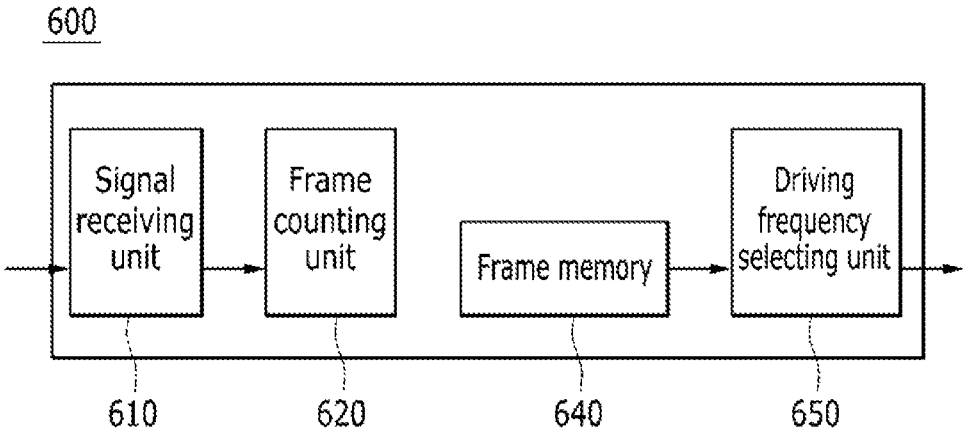

As shown in FIG. 15, if the still image end signal is applied, the frame counting unit 620 counts the number of sequential frames of the motion picture that are inputted after the still image end signal is applied and before the still image start signal is applied (S2170). In this case, the frame counting unit 620 determines whether or not the number of the motion picture sequential frames is equal to or more than set value n. If the number of the motion picture sequential frames is less than n, the storage image data is outputted at the first frequency and the light source unit is driven at the first ratio, like the case where the motion picture start signal is not applied (S2150).

If the still image end signal is applied, but the number of sequential frames of the motion picture is less than n, the graphic processing unit is activated and the input image data is transmitted to the signal receiving unit 610. However, the display panel displays the still image by outputting the storage image data and is driven at the first frequency.

If the number of sequential frames of the motion picture is equal to or more than n, as shown in FIG. 12, the graphic processing unit is activated again so as to transmit the input image data (S2180).

If the number of sequential frames of the motion picture is equal to or more than n, the driving frequency selecting unit 650 selects the second frequency to output the input image data to the display panel at the second frequency (S2190). In this case, the display panel displays the motion picture and is driven at the second frequency.

Simultaneously, the light source driver 910 receives the second frequency as the driving frequency to drive the light source unit at the second ratio.

In the driving method of the display device according to a second exemplary embodiment, when the still image is continuously displayed by m frames or more, the display panel is driven at the first frequency and the light source unit is driven at the first ratio. Further, when the motion picture is continuously displayed by n frames or more, the display panel is driven at the second frequency and the light source unit is driven at the second ratio.

In this case, the first frequency has a value lower than the second frequency. Because the same image is displayed for every frame, the still image may be implemented even at a low driving frequency. However, a charging time of the pixel is changed according to a change in the driving frequency, and the charged charge amount is changed. As a result, the change in the luminance may be recognized with a user's eyes.

Accordingly, the light source unit is dimming-driven, such that the change in the luminance may not be recognized with a user's eyes. In detail, when the display panel is driven at the first frequency, the light source unit is driven at the first ratio and when the display panel is driven at the second frequency, the light source unit is driven at the second ratio.

Further, when the still image is not continuously displayed by m frames or more, and when the motion picture is not continuously displayed by n frames or more, the driving frequency of the display panel and the driving ratio of the light source unit are not changed, but maintained, such that the luminance change may not occur.

When the still image end signal is applied, but the number of sequential frames of the motion picture is less than n, the display panel displays the still image by outputting the storage image data and is driven at the first frequency, but the present disclosure is not limited thereto. On the other hand, when the still image end signal is applied, but the number of sequential frames of the motion picture is less than n, the input image data may be outputted at the second frequency and the light source unit may be driven at the second ratio. In this case, the display panel displays the motion picture and is driven at the second frequency.

Next, a driving method of a display device according to the third exemplary embodiment will be described with reference to FIG. 16 to FIG. 18. A structure of the display device according to the third exemplary embodiment of is the same as the structure of the display device according to the first exemplary embodiment, and thus a description thereof is omitted.

Figure 16:
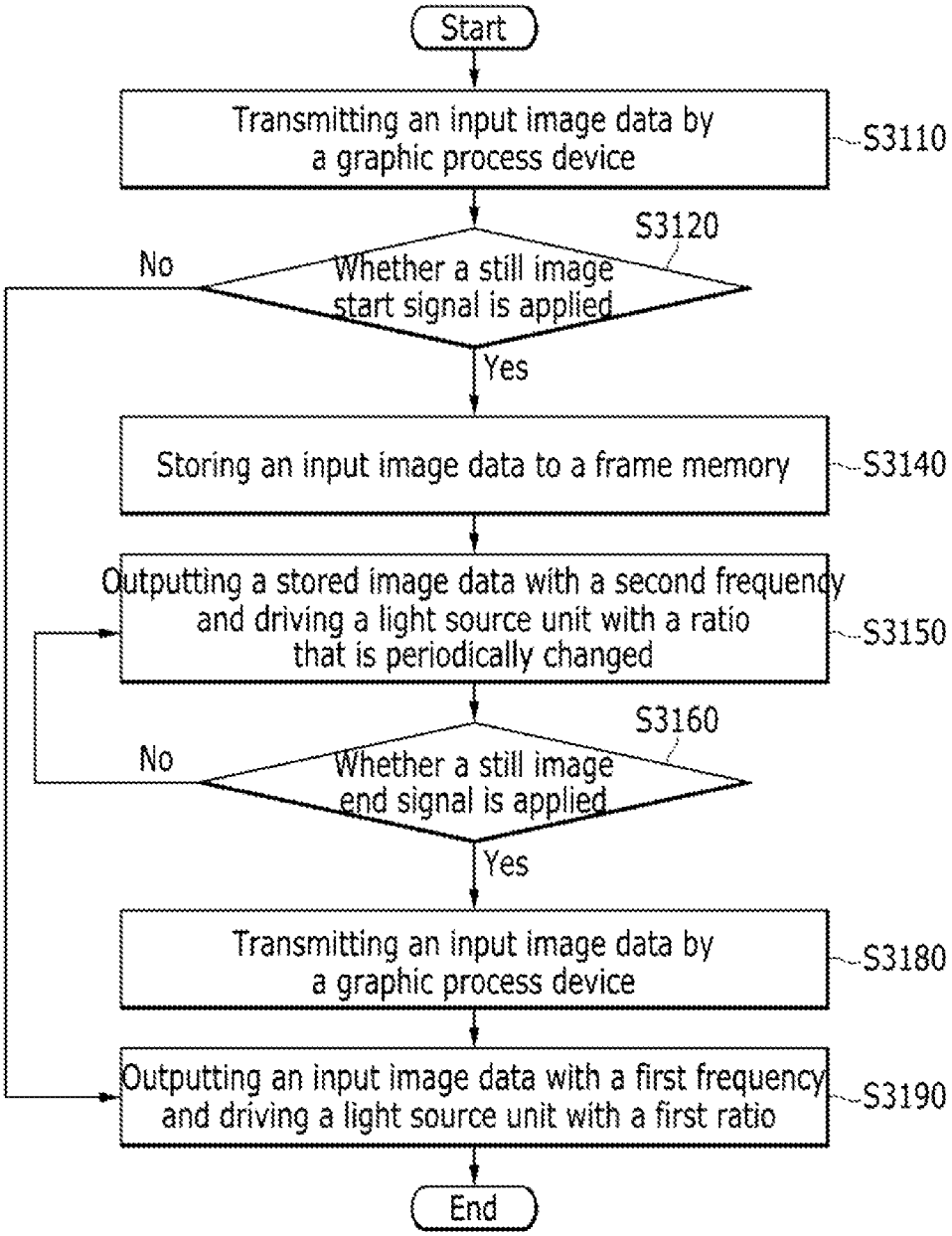
FIG. 16 is a flowchart of a driving method of a display device according to the third exemplary embodiment.
Figure 17:
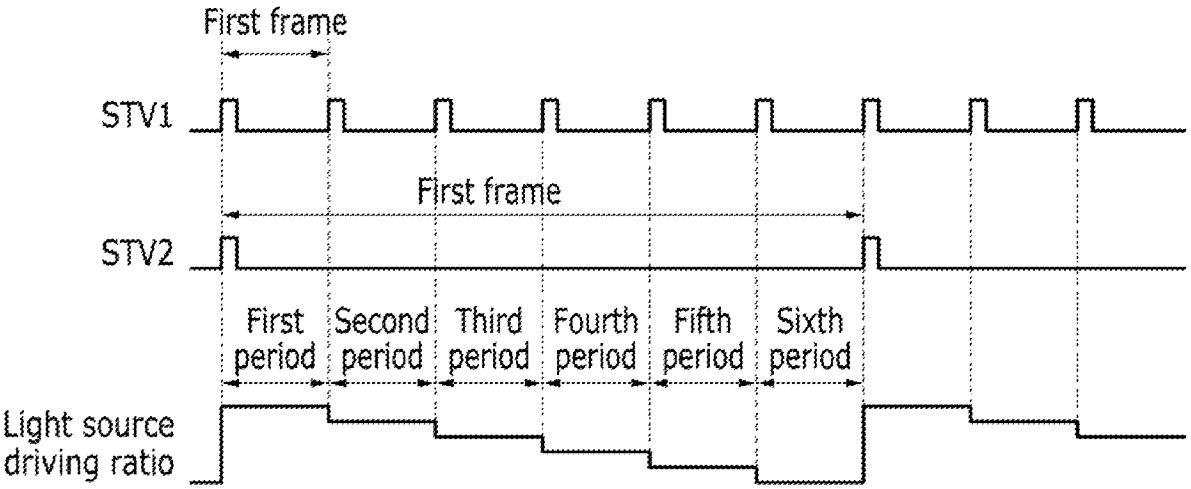
FIG. 17 and FIG. 18 are views of an STV signal and a light source unit driving ratio of a display device according to the third exemplary embodiment.
Figure 18:
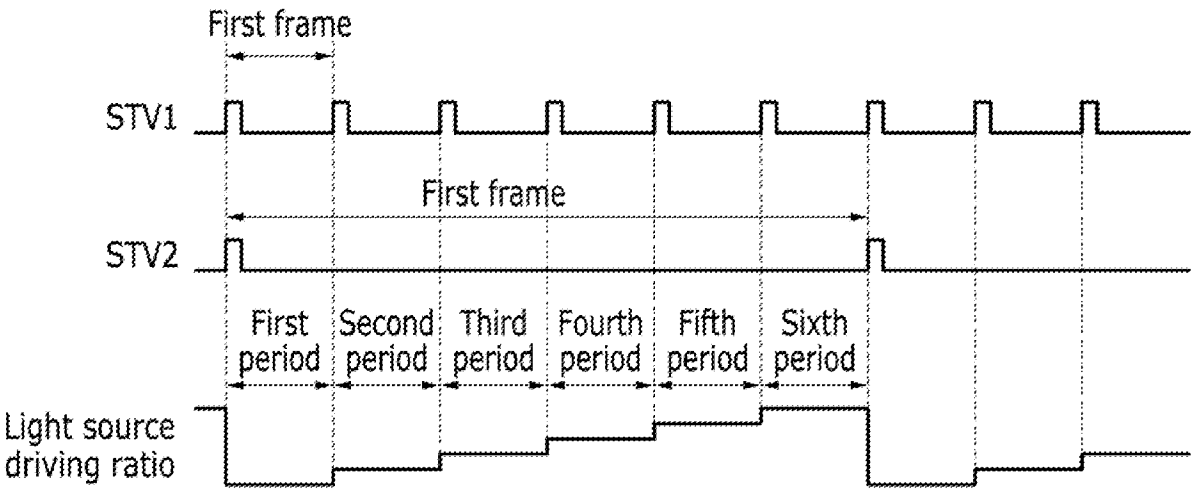

FIG. 16 is a flowchart of a driving method of a display device according to the third exemplary embodiment, and FIG. 17 and FIG. 18 are views of an STV signal and a light source unit driving ratio of a display device according to the third exemplary embodiment.

First, the graphics processing unit transmits the input image data to the signal receiving unit 610 of the signal controller 600 (S3110).

It is determined whether or not the still image start signal is applied to the signal receiving unit (S3120), and if the still image start signal is not applied, the input image data is outputted to the display panel (S3190).

If the still image start signal is applied, the input image data is stored in the frame memory 640 (S3140).

Subsequently, the graphics processing unit is inactivated so that the graphics processing unit does not transmit the input image data and the storage image data stored in the frame memory 640 is outputted. If the still image start signal is applied, the driving frequency selecting unit 650 selects the second frequency to output the storage image data to the display panel at the second frequency (S3150). In this case, the display panel displays the still image and is driven at the second frequency.

Simultaneously, in the light source driver 910, the driving frequency receiving unit 912 receives a second frequency $f_2$ as the driving frequency and the light source unit driving ratio selecting unit 914 selects a second ratio $P_2$ as the driving ratio of the light source unit.

A periodic change of the light source unit driving ratio will be described with reference to FIG. 17.

STV1 of FIG. 17 is an STV signal in use when the display panel is driven with the first frequency, and STV2 is an STV signal in use when the display panel is driven with the second frequency.

When the first frequency is 60 Hz and the second frequency is 10 Hz, STV2 is applied once during a time that STV1 is applied six times. Accordingly, the luminance of the screen is frequently changed when being driven with the first frequency rather than the second frequency, and thereby the flicker is not as noticeable. Accordingly, in the display device according to the third exemplary embodiment, the light source unit driving ratio is changed with the same cycle as the application cycle of the STV1 signal when being driven with the first frequency.

At a position where the STV2 is applied, the light source unit driving ratio selecting unit 914 selects the first ratio with the light source unit driving ratio.

The light source driving signal generator 916 generate a light source driving signal that is capable of driving the light source unit at the first ratio P1 to output the generated light source driving signal to the light source unit. In this case, the light source driving signal may be various signals such as a PWM signal, a communication protocol such as I2C or the like, and the like.

When one frame is divided into the first to the sixth periods having the same length, the light source unit is driven with the first ratio in the first period.

Next, when using, for example, the normally black mode display device, at the position where the second period is started, the light source unit driving ratio selecting unit 914 selects the second ratio that is lower than the first ratio as the light source unit driving ratio to drive the light source unit with the second ratio.

Next, at the position where the third period is started, the light source unit driving ratio selecting unit 914 selects the third ratio that is lower than the second ratio as the light source unit driving ratio to drive the light source unit with the third ratio.

Next, at the position where the fourth period is started, the light source unit driving ratio selecting unit 914 selects the fourth ratio that is lower than the third ratio as the light source unit driving ratio to drive the light source unit with the fourth ratio.

Next, at the position where the fifth period is started, the light source unit driving ratio selecting unit 914 selects the fifth ratio that is lower than the fourth ratio as the light source unit driving ratio to drive the light source unit with the fifth ratio.

Next, at the position where the sixth period is started, the light source unit driving ratio selecting unit 914 selects the sixth ratio that is lower than the fifth ratio as the light source unit driving ratio to drive the light source unit with the sixth ratio.

Next, at the position where the next period is started, the light source unit driving ratio selecting unit 914 again selects the first ratio as the light source unit driving ratio to drive the light source unit with the first ratio.

That is, the light source unit is driven with the first ratio or the ratio that is sequentially decreased from the first ratio. At the position where the STV2 signal is transmitted, the light source unit is driven with the first ratio, and before the transmission of the next STV2 signal, the light source unit is driven with the ratio that is sequentially decreased from the first ratio. In this example, the change cycle of the light source unit driving ratio may be set to be the same as the transmission cycle of the STV1 signal. Accordingly, although the display panel is driven with the second frequency that is lower than the first frequency, the change cycle of the luminance is increased like the driving with the first frequency such that the flicker is not noticed.

Subsequently, it is determined whether or not the still image end signal is applied (S3160), and if the still image end signal is not applied, the storage image data is outputted at the second frequency and the light source unit is driven at the ratio that is periodically changed (S3150).

If the still image end signal is applied, the graphics processing unit is again activated so as to transmit the input image data (S3180).

If the still image end signal is applied, the driving frequency selecting unit 650 selects the first frequency to output the input image data to the display panel at the first frequency. In this case, the display panel displays the motion picture and is driven at the first frequency (S3190).

Simultaneously, in the light source driver 910, the driving frequency receiving unit 912 receives a first frequency as the driving frequency and the light source unit driving ratio selecting unit 914 selects the first ratio as the driving ratio of the light source unit.

The light source driving signal generator 916 generates a light source driving signal capable of driving the light source unit at the first ratio to output the generated light source driving signal to the light source unit.

In the driving method of the displaying device according to the third exemplary embodiment, when the motion image is displayed, the display panel is driven at the first frequency and the light source unit is driven at the first ratio. Further, when the still picture is displayed, the display panel is driven at the second frequency and the light source unit is driven at the second ratio.

In the above, the case of using the normally black mode display device was described. The periodic change of the light source unit driving ratio of the case using the normally white mode display device will now be described with reference to FIG. 18.

At the position where the STV2 is applied, the light source unit driving ratio selecting unit 914 selects the first ratio as the light source unit driving ratio to drive the light source unit with the first ratio.

Next, at the position where the second period is started, the light source unit driving ratio selecting unit 914 selects the second ratio that is higher than the first ratio as the light source unit driving ratio to drive the light source unit with the second ratio.

Next, in the third period to the sixth period, the light source unit is driven with the ratio that is gradually increased from the second ratio.

That is, when driving the display panel with the second frequency, in the normally black mode display device, the light source unit is driven with the first ratio and the ratio that is sequentially decreased from the first ratio in each subsequent frame until the next STV2 signal. In contrast, in the normally white mode display device, the light source unit is driven with the first ratio and the ratio that is sequentially increased from the first ratio in each subsequent frame until the next STV2 signal.

While the embodiments have been described in connection with what is presently considered to be practical exemplary embodiments, it is to be understood that the invention is not limited to the disclosed embodiments, but, on the contrary, is intended to cover various modifications and equivalent arrangements included within the spirit and scope of the disclosure, including the appended claims.

DESCRIPTION OF SYMBOLS

| | |
|---|---|
| 300: Display panel | 400: Gate driver |
| 500: Data driver | 600: Signal controller |
| 610: Signal receiving unit | 620: Frame counting unit |
| 640: Frame memory | 650: Driving frequency selecting unit |
| 700: Graphic processing unit | 900: Light source unit |
| 910: Light source driver | 912: Driving frequency receiving unit |
| 914: Light source unit driving ratio selecting unit | |
| 916: Light source driving signal generator | |

What is claimed is:

1. A display device, comprising:

a display panel configured to display both a still image and a motion picture;

a signal controller configured to control signals for driving the display panel;

a graphic processing unit configured to transmit input image data to the signal controller;

a light source unit configured to irradiate the display panel with light; and a light source driver configured to control signals for driving the light source unit, wherein the signal controller includes a frame memory storing the input image data, the signal controller is configured to control the display panel so as to drive the display panel at a first frequency or a second frequency, and the light source driver is configured to drive the light source unit at a first ratio when the display panel is driven at the first frequency and drives the light source unit at a second ratio when the display panel is driven at the second frequency, wherein the graphic processing unit is configured to transmit a still image start signal and a still image end signal to the signal controller, wherein the signal controller is configured to store the input image data in the frame memory and inactivate the transmission of the input image data when the still image start signal is applied and activate the transmission of the input image data when the still image end signal is applied, wherein the signal controller is configured to output the storage image data stored in the frame memory to the display panel at the first frequency when the still image start signal is applied and output the input image data to the display panel at the second frequency when the still image end signal is applied, wherein the first frequency has a value lower than the second frequency, the first ratio has a value lower than the second ratio when the display panel is in a normally black mode, and the first ratio has a value higher than the second ratio when the display panel is in a normally white mode.

2. The display device of claim 1, wherein:

the signal controller further includes a signal receiving unit configured to transmit the input image data from the graphic processing unit; and a driving frequency selecting unit configured to select the first frequency when the still image is to be displayed and select the second frequency when the motion picture is to be displayed.

3. The display device of claim 1, wherein:

the light source driver includes a driving frequency receiving unit configured to receive a driving frequency of the display panel from the signal controller;

a light source unit driving ratio selecting unit configured to determine a driving ratio of the light source unit according to the driving frequency; and a light source driving signal generator configured to generate a signal for driving the light source according to the driving ratio of the light source unit.

4. The display device of claim 1, wherein: the signal controller further includes a frame counting unit configured to count the number of sequential frames of the still image inputted after the still image start signal is applied and before the still image end signal is applied and count the number of sequential frames of the motion picture inputted after the still image end signal is applied until the still image start signal is applied.

5. The display device of claim 4, wherein:

the signal controller is configure to store the input image data in the frame memory and inactivate the transmission of the input image data when the number of sequential frames of the still image is equal to or more than m, and activate the transmission of the input image data when the number of sequential frames of the motion picture is equal to or more than n.

6. The display device of claim 4, wherein:

the signal controller is configured to output the storage image data stored in the frame memory to the display panel at the first frequency when the number of sequential frames of the motion picture is equal to or more than m and output the input image data to the display panel at the second frequency when the number of sequential frames of the motion picture is equal to or more than n.

7. A driving method of a display device, comprising:

transmitting input image data to a signal controller from a graphic processing unit;

applying a still image start signal;

driving a display panel at a first frequency and driving a light source unit at a first ratio; applying a still image end signal; and driving the display panel at a second frequency and driving the light source unit at a second ratio, wherein applying a still image start signal includes storing the input image data in a frame memory, and the method further comprises inactivating transmission of the input image data when the still image start signal is applied, and activating transmission of the input image data is activated when the still image end signal is applied, comprising outputting the image data stored in the frame memory to the display panel at the first frequency when the still image start signal is applied, and outputting the input image data the display panel at the second frequency when the still image end signal is applied, wherein the first frequency has a value lower than the second frequency, the first ratio has a value lower than the second ratio when the display panel is in a normally black mode, and the first ratio has a value higher than the second ratio when the display panel is in a normally white mode, and wherein the display panel displays a still image and a motion picture, and the display panel is driven at the first frequency when the still image is displayed and driven at the second frequency when the motion picture is displayed.

8. The driving method of a display device of claim 7, further comprising counting a number of sequential frames of the still image inputted after the still image start signal is applied and before the still image end signal is applied, and counting a number of sequential frames of the motion picture inputted after the still image end signal is applied until the still image start signal is applied.

9. The driving method of a display device of claim 8, wherein:

when the number of the sequential frames of the still image is equal to or more than a value m, the input image data is stored in the frame memory and the transmission of the input image data is inactivated, and when the number of the sequential frames of the motion picture is equal to or more than a value n, the transmission of the input image data is activated.

10. The driving method of a display device of claim 9, wherein:

when the number of the still image sequential frames is equal to or more than the value m the storage image data stored in the frame memory is outputted to the display panel at the first frequency and, when the number of sequential frames of the motion picture is equal to or more than the value n the input image data is outputted to the display panel at the second frequency.

11. The driving method of a display device of claim 7, wherein:

the first ratio and the second ratio are selected by using at least one of a lookup table or a function.

12. The driving method of a display device of claim 7, wherein:

a conversion from driving the display panel at the first frequency to driving the display panel at the second frequency is performed in a vertical blank time; and a conversion from driving the lights source at the first ratio to driving the light source at the second ratio is performed in the vertical blank time.

* * * * *